US008331814B2

(12) United States Patent
Komatsu

(10) Patent No.: US 8,331,814 B2
(45) Date of Patent: Dec. 11, 2012

(54) IMAGE FORMING APPARATUS FEATURING A CONTROLLED AC VOLTAGE CHARGING DEVICE FOR CHARGING A PHOTOSENSITIVE MEMBER

(75) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 12/711,357

(22) Filed: Feb. 24, 2010

(65) Prior Publication Data

US 2010/0221026 A1 Sep. 2, 2010

(30) Foreign Application Priority Data

Mar. 2, 2009 (JP) ..... 2009-048307
Jan. 12, 2010 (JP) ..... 2010-003629

(51) Int. Cl.
*G03G 15/00* (2006.01)

(52) U.S. Cl. ..... 399/50

(58) Field of Classification Search ..... 399/50, 399/174, 176
See application file for complete search history.

(56) References Cited

U.S. PATENT DOCUMENTS 7,116,922 B2 * 10/2006 Takahashi et al. ..... 399/50
7,634,206 B2 * 12/2009 Hagiwara et al. ..... 399/50

FOREIGN PATENT DOCUMENTS

JP 2001-201920 A 7/2001
JP 2001-201922 A 7/2001
JP 2002-287466 A 10/2002
JP 2008-139545 A 6/2008

* cited by examiner

*Primary Examiner* — William J Royer
(74) *Attorney, Agent, or Firm* — Fitzpatrick, Cella, Harper & Scinto

(57) ABSTRACT

The present invention provides an image forming apparatus which includes a rotatable photosensitive member, a charging device which charges the photosensitive member, an applying unit which applies an alternating current voltage to the charging device, a processing portion which extracts a discharge current component by removing an alternating current component corresponding to the alternating current voltage from a current flowing between the photosensitive member and the charging device, and a control unit which controls a peak-to-peak value of the alternating current voltage based on the discharge current component extracted by the processing portion.

12 Claims, 9 Drawing Sheets

IMAGE FORMING APPARATUS FEATURING A CONTROLLED AC VOLTAGE CHARGING DEVICE FOR CHARGING A PHOTOSENSITIVE MEMBER

BACKGROUND OF THE INVENTION

1. Field of the Invention

The present invention relates to an image forming apparatus that includes a charging device for charging a photosensitive member.

2. Description of the Related Art

Recently, image forming apparatuses adopting a contact charging system that uses lower voltages and produces less ozone than a corona charger have been used. For example, an main body of an image forming apparatus that charges an image bearing member by use of a charging roller can be made more compact than that with a corona charger. To charge a photosensitive member serving as an image bearing member by use of a charging roller, a voltage in which AC (alternating current) and DC (direct current) voltages overlap is applied to the charging roller. Thereby, the photosensitive member is uniformly charged. An "alternating current charging system" in which an image bearing member is charged by a voltage in which alternating current and direct current voltages overlap can charge the image bearing member more uniformly than a "direct current charging system" in which an image bearing member is charged by a direct current voltage only. However, the "alternating current charging system" is greater than the "direct current charging system" in the quantity of discharge to the image bearing member. A large quantity of discharge increases the production of discharge products, which are factors of image flow and wear to an image bearing member. In view of the foregoing problem, Japanese Patent Application Laid-Open No. 2001-201920 discloses a method in which while uniform charging is ensured by the "alternating current charging system," an alternating current voltage (peak-to-peak value) is set for minimizing the required quantity of discharge.

However, the relation between the voltage and the quantity of discharge changes according to the thickness of photosensitive and dielectric layers of an image bearing member, changes in ambient air, or type of charging member. For example, in a low temperature and low humidity environment (15° C. temperature and 10% or less humidity, hereinafter referred to as L/L environment), a material dries and the resistance increases, making it difficult to generate a discharge. Conversely in a high temperature and high humidity environment (at least 30° C. temperature and at least 80% humidity, hereinafter referred to as H/H environment), a material absorbs moisture and resistance decreases, making it easier to generate a discharge. If the alternating current voltage of a peak-to-peak value suitable for an L/L environment is applied to a charging roller in an H/H environment, the quantity of discharge increases beyond the necessary level. Increases in the quantity of discharge lead to "increases in wear to image bearing members," "image flow (blurring of electrostatic latent images) caused by discharge products," or "toner fusion."

To overcome the foregoing problems, the quantity of discharge current has been controlled for a predetermined number of sheets in order to ensure appropriate charging regardless of the environmental changes. Next, discharge current control as disclosed in Japanese Patent Application Laid-Open No. 2001-201920 will be briefly described.

In conventional discharge current control, the peak-to-peak value of an alternating current voltage applied to a charging member is adjusted. Then, the overall current flowing between the charging member and the image bearing member at several points in an undischarged area and at several points in a discharged area are measured. After a discharge initiating point is calculated from the measurement result, a peak-to-peak value is controlled based on the relation between the peak-to-peak value of the alternating current voltage and the amount of discharge current, so as to produce an appropriate quantity of discharge current (see FIG. 9).

In a conventional control of discharge current, an appropriate quantity of discharge current is ensured immediately after the control of the quantity of discharge current. However, this quantity of discharge deviates from the appropriate level before the subsequent control of discharge current. To avoid this, the quantity of discharge current is frequently controlled so as to minimize any difference from an appropriate quantity of discharge current. However, in a conventional control of the quantity of discharge current, in which the peak-to-peak value of the alternating current voltage is adjusted and the overall current is measured at a number of points, entails a longer control time, which decreases productivity.

SUMMARY OF THE INVENTION

The present invention provides an image forming apparatus including: a photosensitive member able to rotate; a charging device which charges the photosensitive member; an applying unit which applies an alternating current voltage to the charging device; a processing portion which extracts a discharge current component by removing an alternating current component corresponding to the alternating current voltage from a current flowing between the photosensitive member and the charging device; and a control unit which controls a peak-to-peak value of the alternating current voltage based on the discharge current component extracted by the processing portion.

Further features of the present invention will become apparent from the following description of exemplary embodiments with reference to the attached drawings.

DESCRIPTION OF THE EMBODIMENTS

Figure 1:
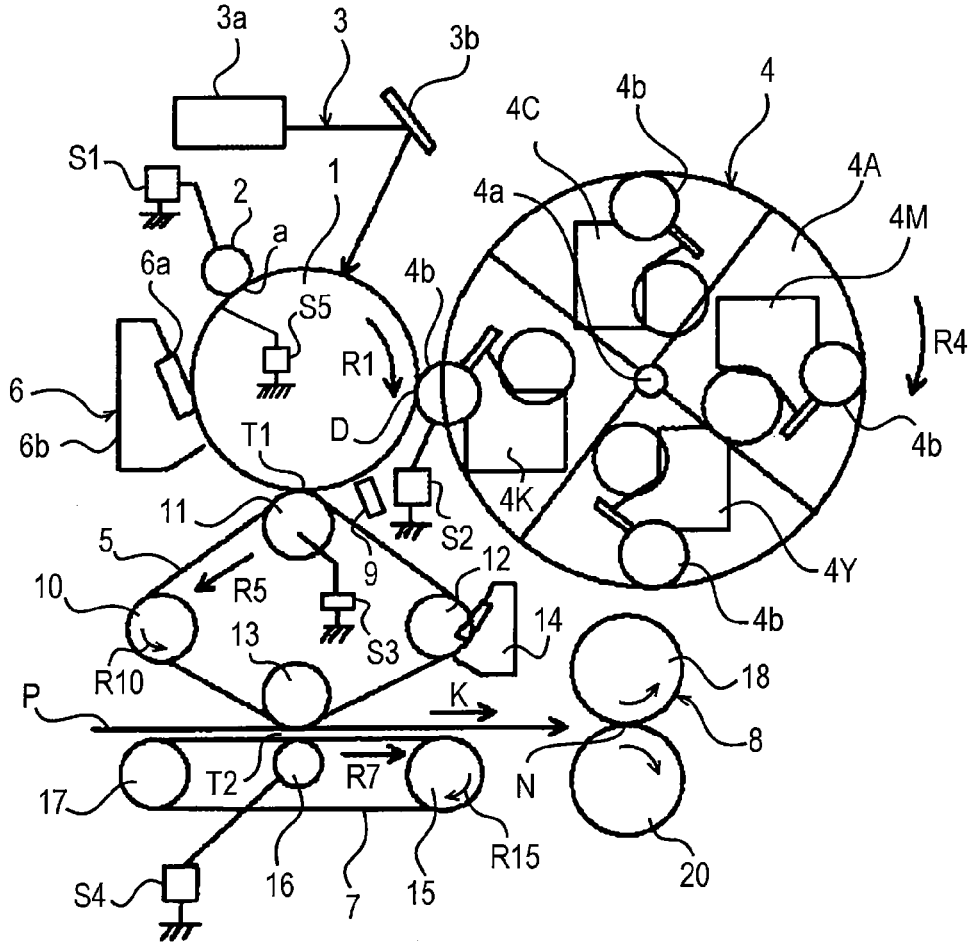
FIG. 1 is a schematic view of an image forming apparatus according to an embodiment of the present invention.
Figure 2A:
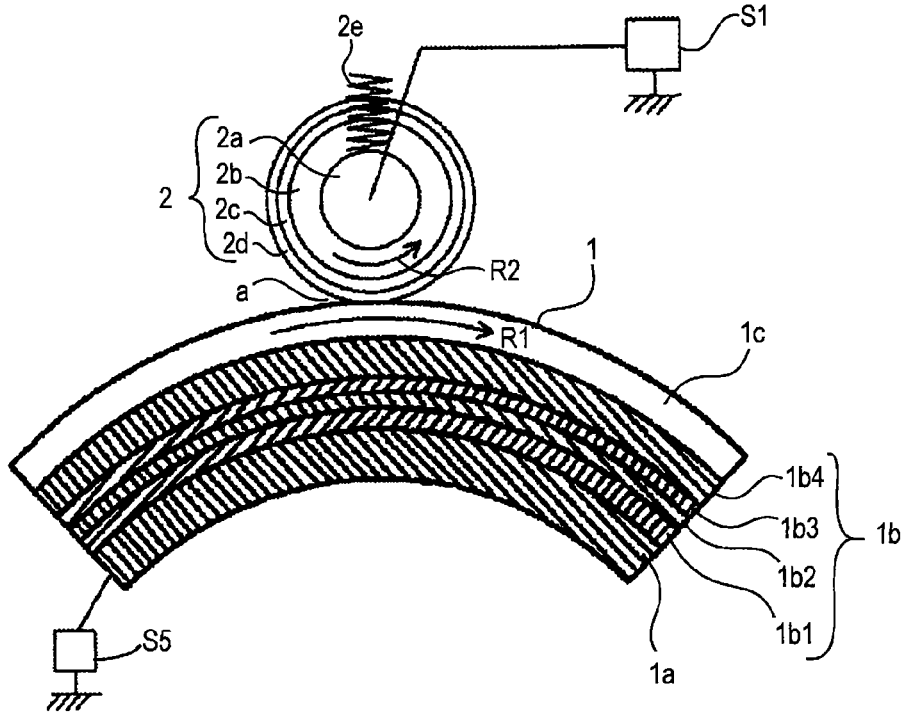
FIG. 2A is an enlarged detailed view of an area where a photosensitive drum is charged by a charging roller.
Figure 2B:
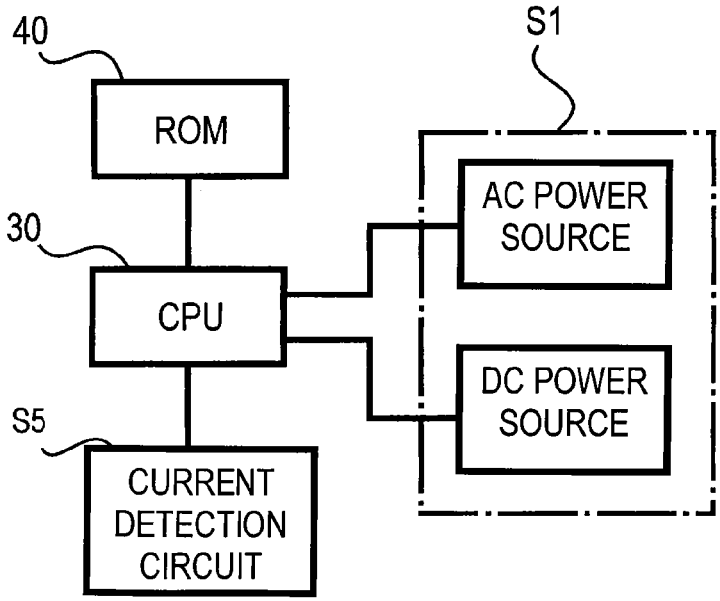
FIG. 2B is a block diagram of a control circuit for the image forming apparatus.

An embodiment of the present invention will be described in detail with reference to the drawings. FIG. 1 is a sectional view of a schematic configuration of a full-color printer serving as an image forming apparatus. FIG. 2A is an enlarged detailed view of an area where a photosensitive drum is charged by a charging roller. FIG. 2B is a block diagram of a control circuit for the image forming apparatus.

§1. Schematic Configuration of the Image Forming Apparatus

The image forming apparatus illustrated in FIG. 1 has a drum type electrophotographic photosensitive member (hereinafter referred to as "photosensitive drum") 1 serving as an image bearing member. This photosensitive drum 1 is supported so as to freely rotate in the direction of arrow R1.

Disposed in order around the photosensitive drum 1 from the upstream side along the direction of rotation of the photosensitive drum 1 are a charging roller (charging portion) 2, exposure device (exposure unit) 3, development device (developing unit) 4, intermediate transfer belt 5, and cleaning device (cleaning unit) 6. Disposed below the intermediate transfer belt 5 is a transfer conveyance belt 7.

A fixing device (fixing unit) 8 is disposed downstream of the transfer conveyance belt 7 in the direction of conveyance (the direction of arrow K) of a recording material (e.g., a sheet of paper or a transparent film) P. The photosensitive drum 1 to fixing device 8 will be described in detail below, in that order.

Photosensitive Drum

The photosensitive drum 1 has a diameter of 60 mm and a length of 350 mm in a longitudinal direction. In the photosensitive drum 1, as illustrated in FIG. 2A, a photosensitive layer 1*b* of a standard Organic Photoconductor (OPC) is formed on the face of a drum substrate 1*a* made of a conductive material, such as aluminum, grounded via a current detection circuit S5. An Over Coat Layer (OCL) 1*c* of excellent wear resistance is formed on the photosensitive layer 1*b*. The OPC has a negative charging characteristic.

The photosensitive layer 1*b* has four layers: a Conductive Pigment Layer (CPL) 1*b*1, Under Coat Layer (UCL) 1*b*2, Carrier Generation Layer (CGL) 1*b*3, and Carrier Transport Layer (CTL) 1*b*4. The photosensitive layer 1*b* is generally an insulator and becomes a conductor when exposed to light irradiation of a specific wavelength. This is because, electron holes (electron pairs) are created in the carrier generation layer 1*b*3 by the light irradiation and charges are caused to flow. The carrier generation layer 1*b*3 is formed from a phthalocyanine compound of 0.2 μm thickness. The carrier transport layer 1*b*4 is formed from a polycarbonate of approximately 25 μm thickness in which hydrazone compounds are dispersed. The photosensitive drum 1 is rotated and driven in the direction of arrow R1 by a drive unit (not illustrated).

Charging Roller

The charging roller 2 is a contact charging member in the form of a roller. The present embodiment uses one with a diameter of 14 mm and a length of 320 mm in a longitudinal direction. The charging roller 2 uniformly charges the surface (periphery) of the photosensitive drum 1 to a predetermined polarity and potential. The charging roller 2 is formed by covering the periphery of a metal core 2*a* with an elastic layer 2*b*, a resistance layer 2*c*, and a surface layer 2*d*. Both ends of the core 2*a* are held lengthwise by bearing members (not illustrated) so as to be freely rotated. The bearing member is biased toward the photosensitive drum 1 by a pressing spring (compression spring) 2*e* serving as a biasing member. Thereby, the charging roller 2 is firmly pressed against the surface of the photosensitive drum 1 with a predetermined pressure, thus defining a charging portion (charging nip portion) (a) between the surface of the photosensitive drum 1 and the charging roller 2 itself. Thus, a minute empty space (charging gap portion) is defined between the charging roller 2 and photosensitive member 1. A discharge is generated in this charging gap portion, thereby charging the photosensitive member 1. The charging roller 2 rotates in the direction of arrow R2 following rotation of the photosensitive drum 1 in the direction of arrow R1.

A charging bias application power source S1 having direct current and alternating current power sources applies a charging bias to the charging roller 2. An oscillation voltage in which direct current and alternating current voltages overlap is applied as a charging bias to the core 2*a* of the charging roller 2 by the charging bias application power source S1. Consequently, the surface of the rotating photosensitive drum 1 is evenly (uniformly) charged to a predetermined polarity and potential. Research has illustrated that a frequency of 1300 Hz, which is a region where moire due to interference from a laser is prevented, is used for the charging roller 2. As illustrated in FIG. 2B, the charging bias application power source S1 and the current detection circuit S5 are connected to a CPU 30, to which a ROM 40 storing control data is connected. Based on detection data obtained by the current detection circuit S5, the charging bias applied by the charging bias application power source S1 is controlled. In the present embodiment, −600 V is set as the charging direct current applied to the charging roller 2, and 1500 V is set as an initial value for the peak-to-peak value (Vpp) for the charging alternating current. The peak-to-peak value of the charging alternating current is controlled based on a detection result obtained from the current detection circuit S5.

Current Detection Circuit

Figure 3:
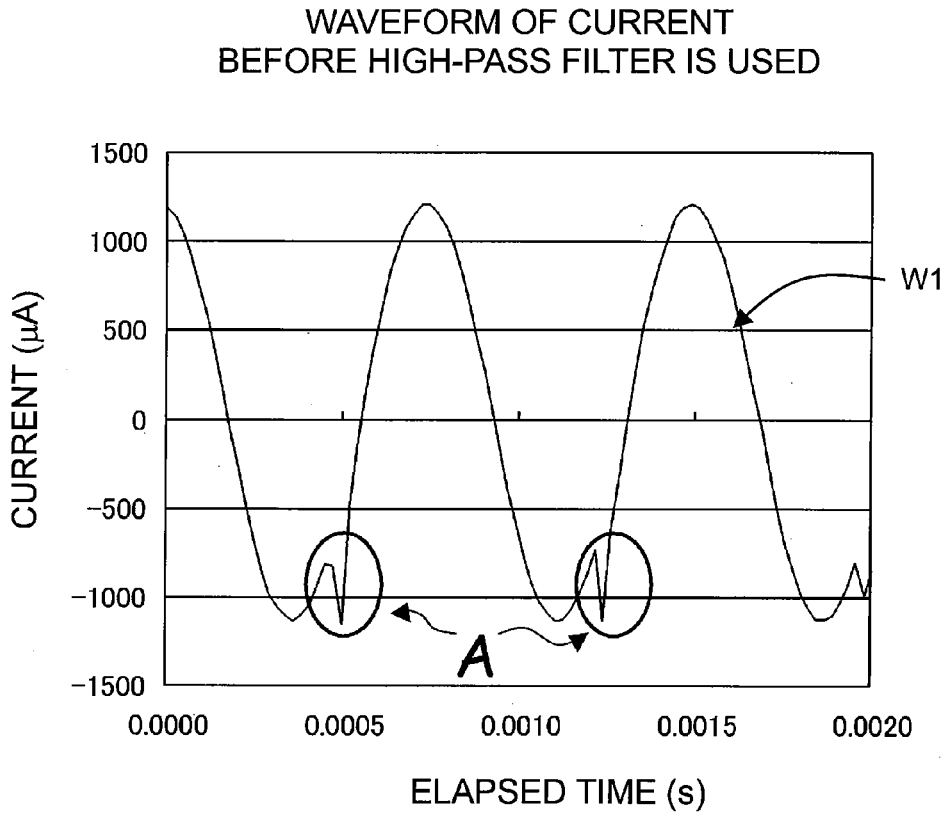
FIG. 3 is a view for describing a waveform of an overall current and a waveform of a discharge current.

FIG. 3 illustrates the waveform of a current detected by a current detection circuit before a high-pass filter is used, when an alternating current voltage that generates discharge is applied to the charging roller. Reference character A in FIG. 3 indicates an increase in current caused by a discharge. In the present embodiment, a power source detection circuit includes a high-pass filter. In the current waveform illustrated in FIG. 3, this high-pass filter passes components of frequency beyond the frequency area of an alternating current voltage applied to the charging roller, and attenuates components of frequency below the frequency area of the alternating current voltage. Accordingly, the current detection circuit S5 can extract the components A of the discharge current in FIG. 3 caused when the charging voltage is applied to the charging roller.

The high-pass filter used to extract discharge current components A may be an analog signal circuit or digital signal circuit. In the present embodiment, the waveform illustrated in FIG. 3 is A/D converted at a sampling frequency of 44.1 kHz and then the component of discharge current is extracted (high-pass filtered) by digital signal processing.

Specifically, a high-pass filter with a sampling frequency of 44.1 kHz, a cutoff frequency of 2000 Hz, and a hamming window function as a window function is used. The digital signal circuit that performs this high-pass filter processing includes a circuit that has a 101-step (steps or orders in filter design or taps) circuit including a delay element. Frequency resolution increases with the number of steps. However, this lengthens the time required for a filtering process. In the present embodiment, the digital signal processing circuit for removing a current component other than electric components is composed of an Application Specific Integrated Circuit (ASIC). A Filed Programmable Gate Array (FPGA) may be used or a highly versatile Digital Signal Processor (DSP) may be operated so as to follow a program.

As a matter of course, an analog signal circuit that has a frequency transmission characteristic that passes a high frequency component and attenuates a low frequency component may be used.

A cutoff frequency is a frequency in which the output of a frequency lower than a cutoff frequency is $1/\sqrt{2}$ of an output (passed frequency) higher than the cutoff frequency.

Other Devices

As shown in FIG. 1, the exposure device 3 uses a laser scanner 3*a* that ON/OFF controls a laser beam according to image information. A laser beam generated by the laser scanner 3*a* is emitted onto the charged surface of the photosensitive drum 1 via a reflecting mirror 3*b*. Consequently, electric charges in an area exposed to the laser beam are removed and an electrostatic latent image is formed.

As a development device 4, a rotary developing system is used. The development device 4 includes: a rotating member 4A rotated and driven in the direction of arrow R4 by a motor (not illustrated) around a shaft 4*a*, and four development devices, i.e., yellow, magenta, cyan, and black development devices 4Y, 4M, 4C, and 4K, all of which are mounted on the rotating member 4A.

For example, to form a black developer image (toner image) on the photosensitive drum 1, the black development device 4K is conveyed to a developing portion (development portion) D opposite the surface of the photosensitive drum 1 by rotation of the rotating member 4A in the direction of the arrow R4. Then, a development bias application power source S2 applies a development bias to a developing sleeve 4*b*. Consequently, an electrostatic latent image on the photosensitive drum 1 is developed with black toner. Similarly, to form a yellow toner image, the rotating member 4A is rotated 90° in the direction of the arrow R4 to dispose the yellow development device 4Y in the developing portion D in order to carry out such development. Magenta and cyan toner images are formed in the same manner. The present embodiment employs so-called reversal development, which is carried out using toner having an electric charge with a (negative) polarity that is the same as the charging characteristic of the photosensitive drum 1. As a development bias, an oscillation voltage is used in which alternating current and direct current voltages overlap. In the description below, each of the development devices 4Y, 4M, 4C, and 4K is simply called "a development device" when it is not necessary to distinguish particular colors.

A toner concentration sensor 9 is located between the development device 4 and the intermediate transfer belt 5 and optically measures the density of a toner image formed on the photosensitive drum 1 without contact with the toner image. As a light source for a light emitting portion, an infrared LED with a center wavelength of 800 nm is used.

The intermediate transfer belt 5 extends around a drive roller 10, a primary transfer roller (primary transfer charger) 11, a follower roller 12, and a secondary transfer counter roller 13. The intermediate transfer belt 5 rotates in the direction of arrow R5 at the same time that the drive roller 10 rotates in the direction of arrow R10. The intermediate transfer belt 5 is pressed against the surface of the photosensitive drum 1, thereby defining a primary transfer portion (primary transfer nip portion) T1 between the photosensitive drum 1 and the intermediate transfer belt 5.

Connected to the primary transfer roller 11 is a primary transfer bias application power source S3 for applying a primary transfer bias thereto, the primary transfer roller 11 being grounded. In addition, a belt cleaner 14 is disposed in contact with the surface of the intermediate transfer belt 5 as it extends around the follower roller 12.

The cleaning device 6 is disposed downstream of a primary transfer nip portion T1 (i.e., upstream of the primary transfer roller 11) in the rotating direction of the photosensitive drum 1. The cleaning device 6 has a cleaning blade (cleaning member) 6*a* disposed in contact with the surface of the photosensitive drum 1 and a cleaning container 6*b* for recovering toner scraped off by the cleaning blade 6*a*.

The transfer conveyance belt 7 extends around a drive roller 15, secondary transfer roller 16, and follower roller 17, and rotates in the direction of arrow R7 at the same time that the drive roller 15 rotates in the direction of arrow R15. The transfer conveyance belt 7 is disposed in contact with the intermediate transfer belt 5 to define a secondary transfer portion (secondary transfer nip portion) T2 between the intermediate transfer belt 5 and the transfer conveyance belt 7 itself. Connected to the secondary transfer roller 16 is a secondary transfer application power source S4 for applying a secondary transfer bias thereto, the secondary transfer roller 16 being grounded.

The fixing device 8 includes a fixing roller 18 incorporating a heater (not illustrated), and a pressure roller 20 pressed against the fixing roller 18, thereby defining a fixing portion N.

Image Forming Operation

Next, an image forming operation performed by the image forming apparatus will be described. In the description below, an example will be given where a full-color image is formed using four colors, that is, black, yellow, magenta, and cyan in that order. Numerical values given below are examples and the present invention is not limited to these values.

The photosensitive drum 1 is rotated and driven at 140 mm/sec in the direction of arrow R1 by a drive unit (not illustrated). The rotating photosensitive drum 1 is uniformly charged to predetermined polarity and potential (e.g., −600 V) by the charging bias applied by the charging bias application power source S1 to the charging roller 2 disposed in contact with the surface of the photosensitive drum 1.

Based on input image information, the exposure device 3 exposes the surface of the charged photosensitive drum 1. Consequently, charges in the exposed portion (the illuminated portion) are removed (e.g., −150 V) and hence an electrostatic latent image is formed on the photosensitive drum 1. This electrostatic latent image is developed by a black development device 4K disposed in a developing position D opposite the surface of the photosensitive drum 1 by rotation of the rotating member 4A in the direction of arrow R4. At this time, an oscillation voltage, in which an alternating current voltage (e.g., an alternating current voltage with a peak-to-peak value of 1.5 kV and a frequency of 8 kHz) overlaps with a direct current voltage (e.g., −450 V), is applied to a developing sleeve 4*b* in a black development device 4K by the development bias application power source S2. Thus, black toner with a negative charge is attached to the illuminated portion of the surface of the photosensitive drum 1 and the electrostatic latent image is developed as a toner image.

To measure toner density on the photosensitive drum 1, the state of the surface of the photosensitive drum 1 with no toner image thereon is determined in advance, and this determination is compared with the determination of the state of the surface with a developed toner image thereon. The toner density sensor 9 does not have to be operated constantly. It is preferable to operate the toner density sensor 9 when it is estimated that the charge state of the toner in the development device 4 has greatly changed, such as when image formation is carried out for the first time after the power source is turned on, or when a large quantity of toner is consumed.

The toner image formed on the surface of the photosensitive drum 1 is primarily transferred to the intermediate transfer belt 5. The toner image on the photosensitive drum 1 is conveyed to a primary transfer portion T1 as the photosensitive drum 1 rotates in the direction of arrow R1. Then the primary transfer bias application power source S3 applies a primary transfer bias (e.g., +400 V) to the primary transfer roller 11. Thus, the toner image is primarily transferred onto the intermediate transfer belt 5. Toner remaining on the surface without having been transferred to the intermediate transfer belt 5 during the primary transfer (i.e., residual toner) is removed by the cleaning blade 6*a* of the cleaning device 6, and the photosensitive drum 1 will then be used for the subsequent image formation in yellow.

The photosensitive drum 1 is charged and exposed in the same manner as for black, thereby forming an electrostatic latent image. This electrostatic latent image is developed as a yellow toner image by rotating the rotating member 4A 90° in the direction of arrow R4, thereby disposing the yellow development device 4Y in the developing position D, and then applying a development bias to its developing sleeve 4*b* from the development bias application power source S2. This yellow toner image is primarily transferred in the primary transfer portion T1 so as to be superposed on the previously transferred black toner image on the intermediate transfer belt 5 by a primary transfer bias applied to the primary transfer roller 11 by the primary transfer bias application power source S3. Residual toner on the surface of the photosensitive drum 1 after transfer of a toner image is removed by the cleaning device 6, and the photosensitive drum 1 will then be used for the subsequent image formation in magenta.

In the same manner, toner images in magenta and cyan are formed on the photosensitive drum 1 in that order. These toner images are then primarily transferred to the intermediate transfer belt 5 sequentially. Thus, toner images in four colors are superposed one upon another on the intermediate transfer belt 5.

The four color toner images on the intermediate transfer belt 5 are secondarily transferred to recording material P. Prior to the secondary transfer, the transfer conveyance belt 7 is brought into contact with the intermediate transfer belt 5 to define the secondary transfer portion T2. The four color toner images on the intermediate transfer belt 5 are conveyed to the secondary transfer portion T2 at the same time that the intermediate transfer belt 5 rotates in the direction of arrow R5.

Meanwhile, the recording material P stored in a sheet cassette (not illustrated) is conveyed by a conveying apparatus (not illustrated) and borne on the surface of the transfer conveyance belt 7, and conveyed to the secondary transfer portion T2 by rotation of the transfer conveyance belt 7 in the direction of arrow R7. At this time, the secondary transfer bias application power source S4 applies a secondary transfer bias to the secondary transfer roller 16 and consequently the four color toner images on the intermediate transfer belt 5 are secondarily transferred onto the recording material P simultaneously.

The recording material P after the secondary transfer of the toner images is peeled off of the intermediate transfer belt 5 and conveyed in the direction of arrow K. Then, in the fixing device 8, while being nipped and conveyed by the fixing roller 18 and pressure roller 20, the toner images are fixed to the surface of the recording material P under heat and pressure. Thus, full-color (four-color) image formation is finished on one sheet of recording material P. Meanwhile, the belt cleaner 14 removes residual toner from the surface of the intermediate transfer belt 5 after the second transfer of the toner images. In monochrome image formation, an electrostatic latent image formed on the photosensitive drum 1 is developed by the development device storing toner of the required color. This toner image is primarily transferred onto the surface of the intermediate transfer belt 5 and then secondarily transferred to recording material P immediately. The recording material P with the toner image transferred thereon is peeled off of the transfer conveyance belt 7. The fixing device 8 then applies heat and pressure to the recording material P, thereby fixing the toner image to its surface.

§2. Controlling the Quantity of Discharge Current

FIG. 3 is a graph illustrating the waveform of a current flowing between the photosensitive drum and the charging roller where a filter is not used. Conventionally, the quantity of discharge current has been controlled using the overall current, including components of discharge current, as illustrated in FIG. 3. In the present invention, from the waveform of the overall current containing components of discharge current as illustrated in FIG. 3, the components of discharge current are extracted by a high-pass filter and used to control the quantity of discharge current. In conventional control of the quantity of discharge current, the overall current is detected by applying only alternating current voltage to the charging roller.

FIG. 3 is an example of the waveform of the overall charging current (hereinafter referred to as overall current) flowing between the photosensitive drum and charging roller. This current waveform is obtained under the following conditions: a direct current voltage of −500 V, an alternating current voltage of 1200 Vpp, a charging frequency of 1300 Hz, and a processing speed of 140 mm/sec. FIG. 3 illustrates the waveform of an alternating current from which applied direct current voltage components are removed. The absolute value of discharge start voltage on the negative electrode is lower than that on the positive electrode. As a result of this comparison, it is found that discharge arises only on one side under the charging conditions described above. This is because the mechanism of discharge differs between the positive and negative electrodes.

Description of Conventional Control of Discharge Current

Figure 9:
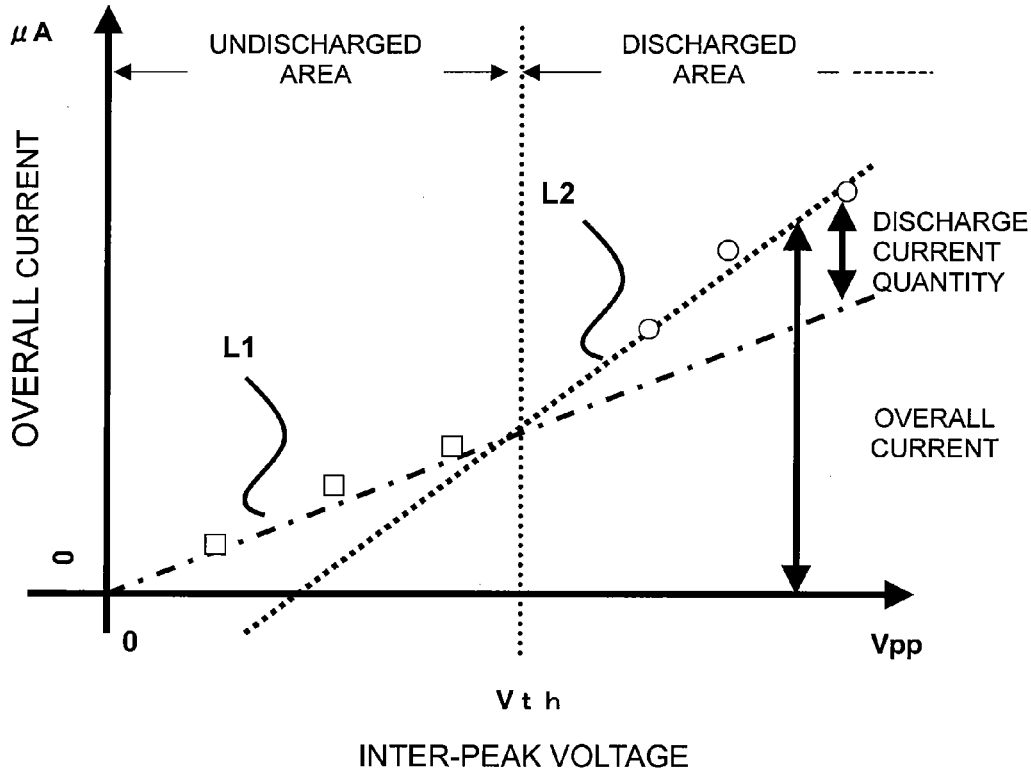
FIG. 9 PRIOR ART
FIG. 9 is a diagram for describing a conventional procedure for discharge current quantity control.

Referring to FIG. 9, conventional control of the quantity of discharge current will be described briefly. In conventional control of the quantity of discharge current, overall currents 530 μA, 600 μA, and 660 μA when the peak-to-peak value of a charging alternating current voltage are adjusted to 800 V, 900 V, and 1000 V (indicated by three points in an undischarged area), respectively, are plotted on a graph. Subsequently, the overall currents 1050 μA, 1150 μA, and 1220 μA when the peak-to-peak value of a charging alternating current voltages are adjusted to 1500 V, 1600 V, and 1700 V (indicated by three points in a discharged area), respectively, are plotted on the graph.

The difference between a straight line L1 approximate to a curved line connecting the three points in the undischarged area and a straight line L2 approximate to a curved line connecting the three points in the discharged area is regarded as the quantity of discharge current. In conventional control of the quantity of discharge current, the peak-to-peak value of the alternating current is controlled so that the quantity of discharge current, obtained from the difference between the two straight lines, is a predetermined value.

In such conventional control, the peak-to-peak values are adjusted six times and currents flowing between the photosensitive drum and the charging roller are measured. Approximately 50 ms is required to adjust the peak-to-peak value at one time. In addition, approximately another 50 ms is required to measure the current flowing between the photosensitive drum and the charging roller at one time. Conventional control of the quantity of discharge current adjusts and measures the peak-to-peak value six times, thus requiring a comparatively long time (approximately (50+50)×6=600 ms). Accordingly, conventional control of the quantity of discharge current, which adjusts the peak-to-peak value of the alternating current a number of times decreases productively in an image non-formation portion between the image forming areas (i.e., between sheets of paper).

Frequency Transmission Characteristics of Filter (Substantially Satisfactory)

The high-pass filter in the present invention, which is used in the current detection circuit S5 for extracting components of discharge current, will now be described in detail. Discharge current control in the present invention focuses on the determination (if any) that the frequency of a component A of a discharge current is higher than the frequency of a charging alternating current voltage. That is, because a component A of the discharge current has a high frequency (approximately 7000 Hz), the component is extracted and processed using a high-pass filter. Two types of high-pass filters (filter 1 and filter 2) will be described as examples. Each of the high-pass filters uses a sampling frequency of 44.1 kHz and a hamming window function as a window function, and has 101 steps.

Figure 4A:
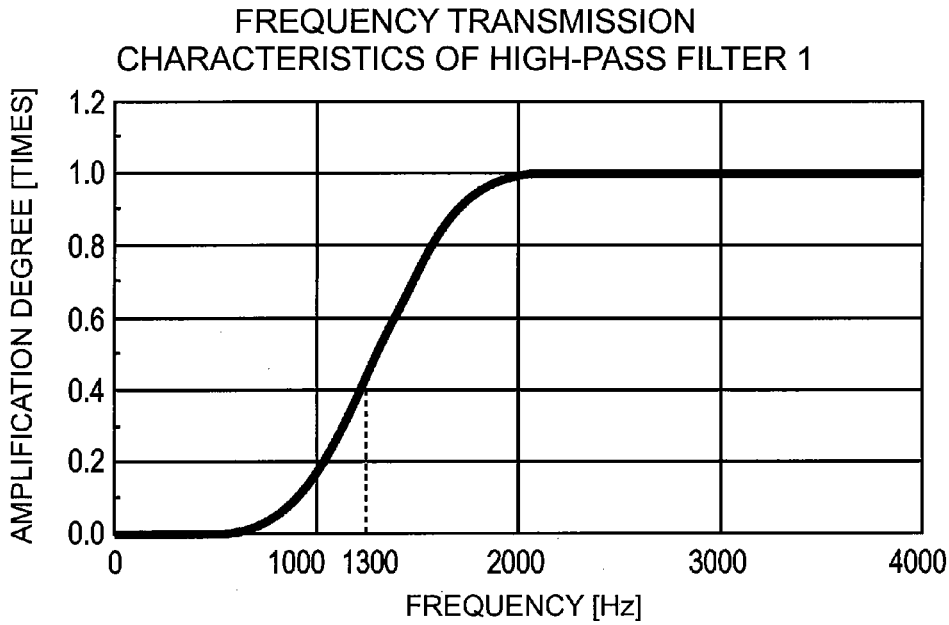
FIGS. 4A and 4B illustrate frequency transmission characteristics of a high-pass filter.

The filter 1 cuts off the charging frequency. FIG. 4A illustrates the frequency transmission characteristics of the filter 1, as a comparative example of the present embodiment. As can be seen from FIG. 4A, the multiplying power of the filter 1 at the frequency (1300 Hz) of the charging alternating current voltage is 0.4.

Figure 4B:
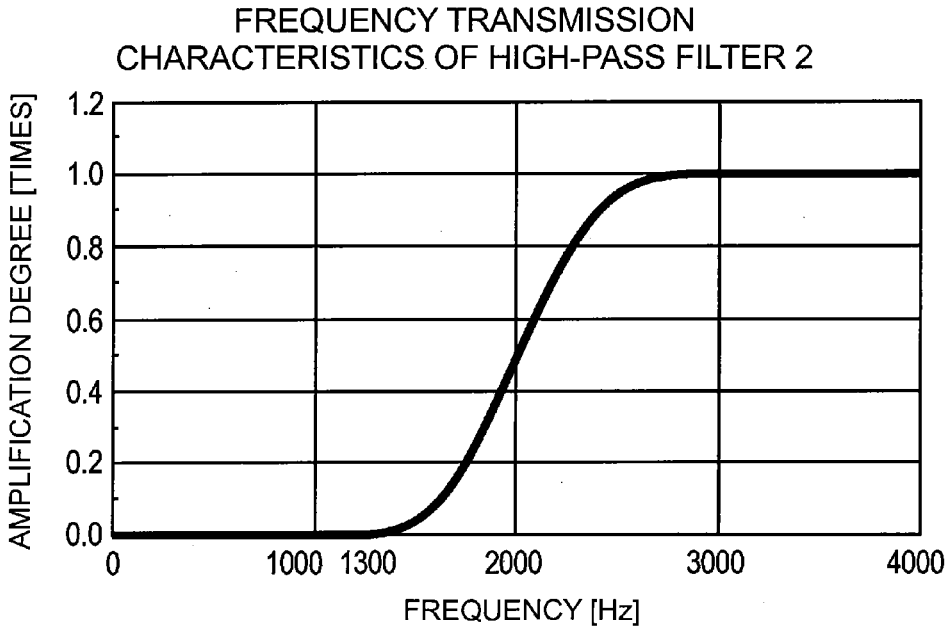

The filter 2 is the filter in which 1.5 times the charging frequency is a cutoff frequency (1950 Hz). FIG. 4B illustrates the frequency transmission characteristics of the filter 2 in the present embodiment, which is a high-pass filter used to extract a component of a discharge current from the waveform of a current. As can be seen from FIG. 4B, the multiplying power of the filter 2 at the frequency (1300 Hz) of the charging alternating current voltage is approximately zero.

Waveform of Signal after Filtering

Figure 5A:
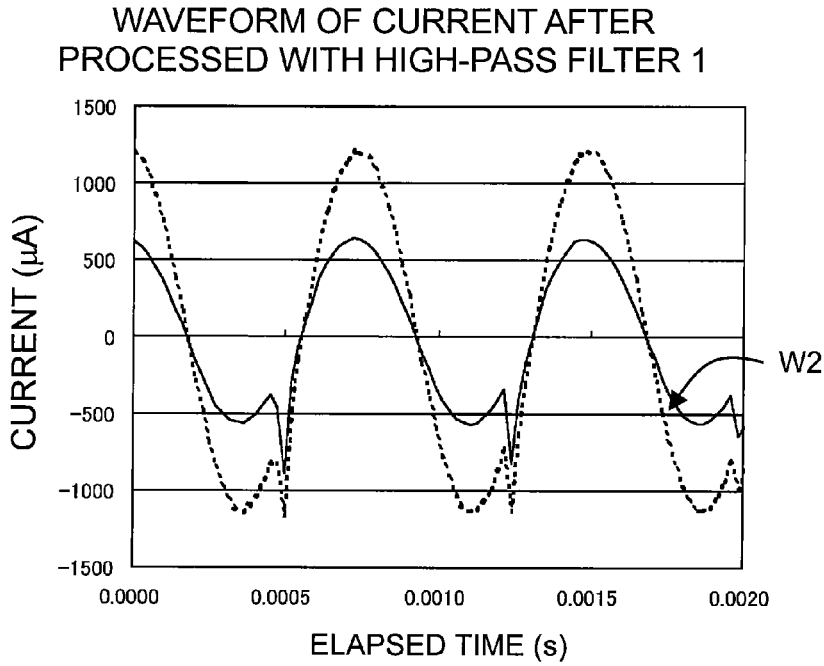
FIGS. 5A and 5B illustrate a waveform after a high-pass filter is used.
Figure 5B:
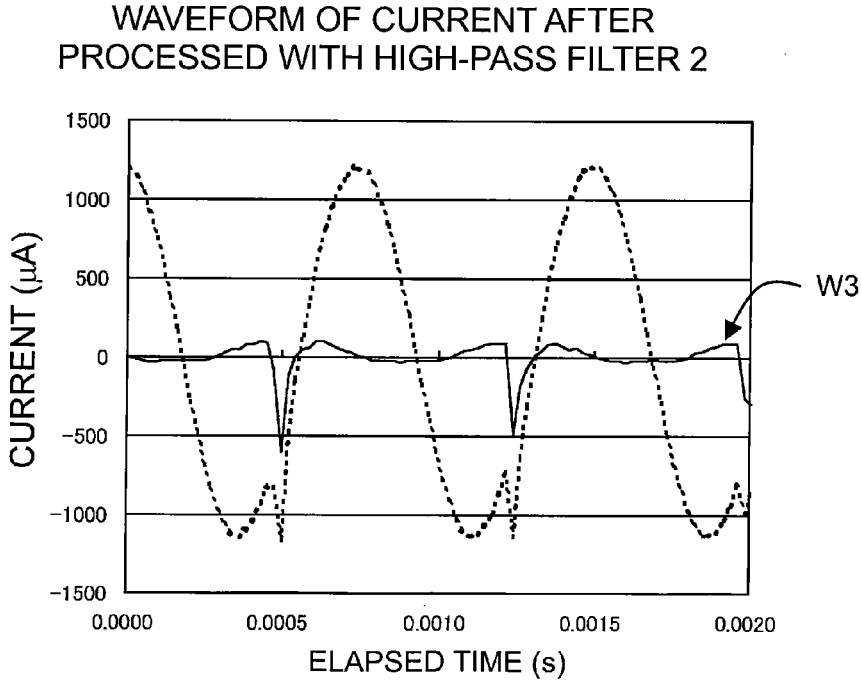

The waveform W1 before filtering, which is indicated by a solid line in FIG. 3, is indicated by a broken line in FIGS. 5A and 5B. FIG. 5A illustrates a waveform W2 obtained by processing the waveform W1 of the overall current by using the filter 1 that has the frequency characteristics illustrated in FIG. 4A. As can be seen from FIG. 5A, where the cutoff frequency of the high-pass filter is set to a frequency equal to the charging frequency, the waveform of the alternating current of the charging alternating current frequency persists. Accordingly, it is found that the filter 1 cannot extract components from the discharge current alone. This is because a certain degree of (approximately 0.5 times) gain at a cutoff frequency (1300 Hz) remains in the frequency transmission characteristics of the filter 1.

FIG. 5B is a waveform W3 obtained by processing the waveform W1 of the overall current by using the filter 2 that has frequency characteristics illustrated in FIG. 4B. As can be seen from FIG. 5B, setting the cutoff frequency of a high-pass filter to 1.5 times (1950 Hz) the charging frequency attenuates the waveform of the charging frequency (1300 Hz) sufficiently and lets the waveform of the frequency (approximately 7000 Hz) of the discharge current to pass. As illustrated in FIG. 5B, it is preferable that any gain at the charging frequency (1300 Hz) be smaller. Specifically, since the filter 2 can substantially nullify the frequency characteristics at the frequency (1300 Hz) of the charging alternating current voltage, the frequency components of the charging alternating current voltage can be removed. In this case, where the quantity of discharge current at 2000 Vpp is approximately 220 μA, the overall current is approximately 1560 μA. Therefore, where the gain at the charging frequency is equal to or below 0.14 (obtained by dividing the quantity of discharge current by the overall current), the waveform of the frequency of the discharge current can be detected.

Accordingly, the waveform of a component of the discharge current can be obtained by performing a process using a high-pass filter in which 1.5 times the charging frequency (1300 Hz) is used as a cutoff frequency.

Difference Due to Filters, and Control of Discharge Current Quantity

Figure 6A:
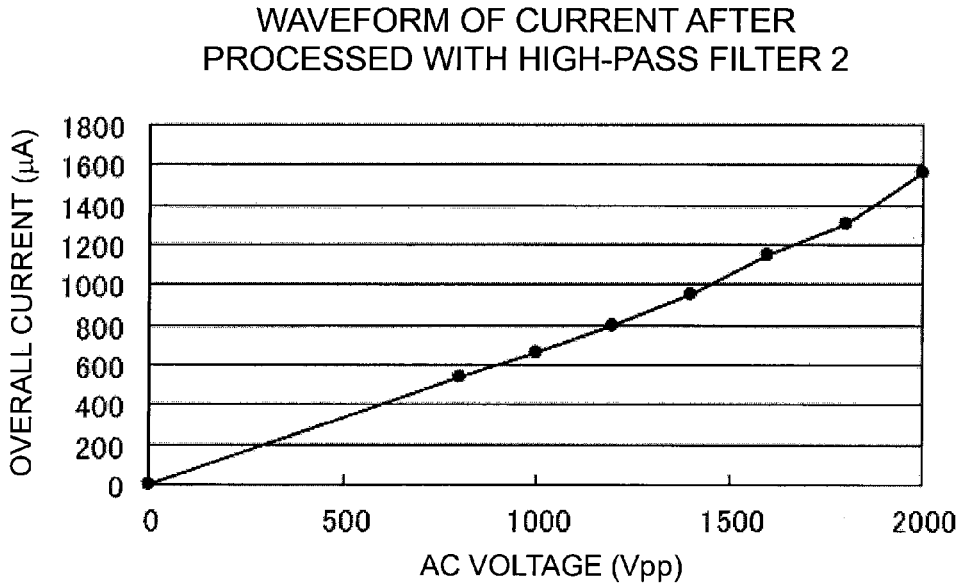
FIGS. 6A and 6B are views for describing a relation between a charging alternating current voltage and a quantity of a discharge current.
Figure 6B:
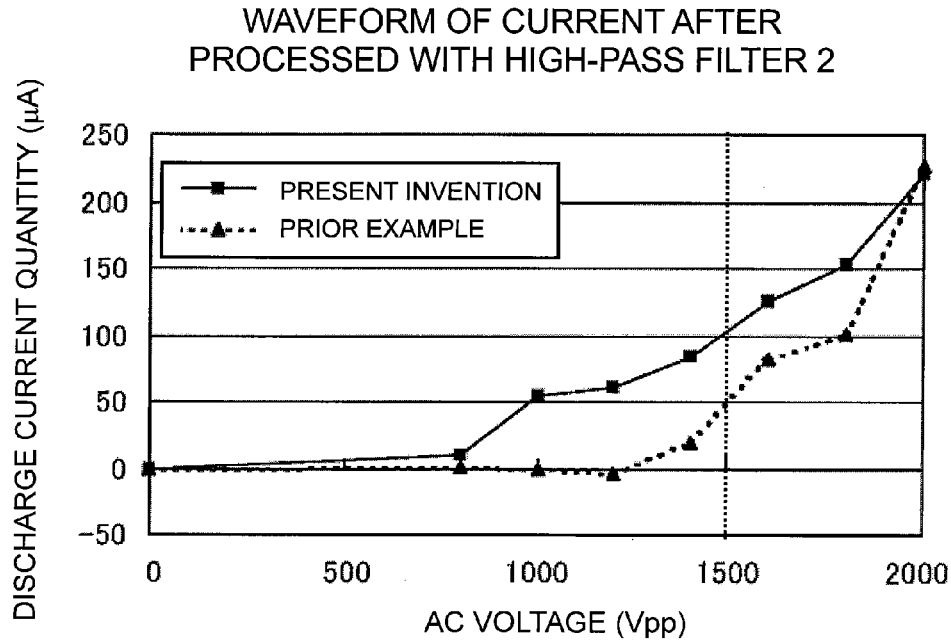

As can be seen from FIG. 6B, there is a difference between the quantity of discharge current which is detected by conventional control of the quantity of discharge current and that which is detected by control as exerted by the present invention. This is because the waveform after processing is deformed by the characteristics of the high-pass filter used in the present invention. However, the difference between the quantity of discharge current obtained by control as exerted by the present invention and that obtained by conventional control is not so significant as to cause problems.

Conventional control of the quantity of discharge current adjusts the target quantity of discharge current so as to achieve both uniform charging and a reduction in drum wear caused by excessive current. That is, in the present invention also, the value that ensures both uniform charging and a reduction in drum wear due to excessive current is assigned as the target quantity for discharge current.

For example, it is supposed that conventional control achieves both uniform charging and a reduction in drum wear by using 50 μl (the quantity of discharge current) as a target control value (see the broken line in FIG. 6B). In this case, the quantity of discharge current (see the solid line in FIG. 6B) obtained using a high-pass filter is set to 100 μA (which is a predetermined value) as a target control value, thereby making uniform charging and a reduction in drum wear compatible with each other. In both cases, the peak-to-peak value of the alternating current voltage is controlled to so as to yield 1500 Vpp.

§3. Flowchart for Control of the Quantity of Discharge Current

FIG. 3 illustrates the waveform W1 of a current flowing between the charging roller and photosensitive drum when a charging voltage in which direct current and alternating current voltages overlap is applied to the charging roller. This waveform of a current flowing between the charging roller and photosensitive drum may be disturbed by a development bias applied to the development device. Therefore, it is preferable to decrease the output of the development bias when the quantity of discharge current is controlled (it is, in fact, preferable to turn off the development bias).

Referring to a flowchart, next will be described the procedure for controlling the peak-to-peak value of an alternating current voltage that a CPU 30 serving as a control unit applies to a charging roller serving as the charging device, based on the result detected and obtained by the current detection circuit S5 provided with the high-pass filter.

Flowchart for Control for the Predetermined Quantity

Figure 7:
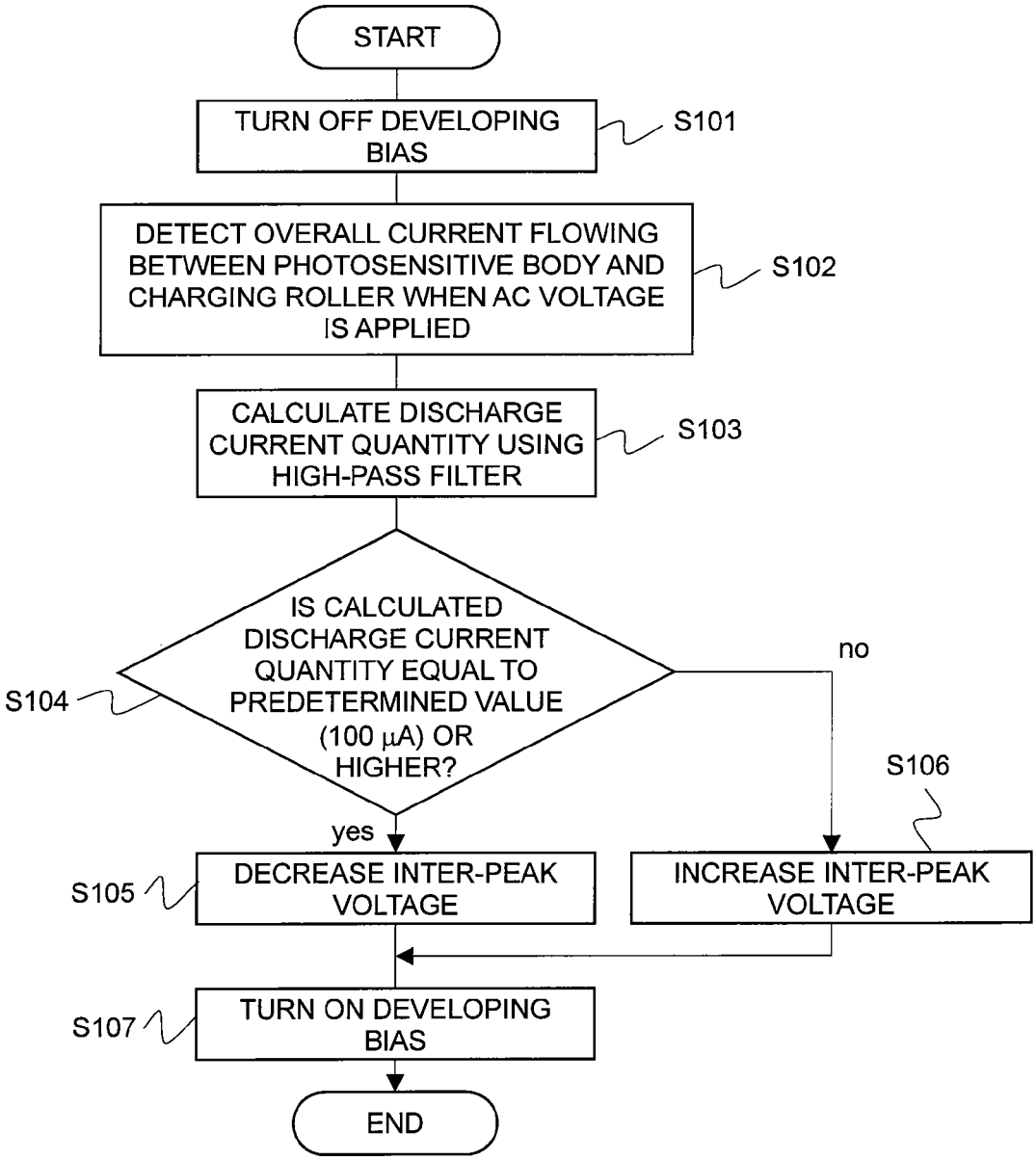
FIG. 7 is a flowchart for discharge current quantity control according to the embodiment of the present invention.

Referring to a flowchart, next will be described control of the quantity of discharge current in an image forming apparatus according to the present embodiment. FIG. 7 is a flowchart illustrating the procedure for control exerted by the CPU 30, as a control unit, for controlling the quantity of discharge current flowing between the photosensitive drum and the charging roller. Following a program stored in the ROM 40, the CPU 30 controls the peak-to-peak value of an alternating current applied to the charging roller. Discharge current control according to the present invention is exerted while an image is not being formed. Control from steps S102 to S106 may be exerted during image formation.

First, development bias is turned off to prevent disturbance of the waveform of a current obtained by the current detection circuit S5. The CPU 30 as controller sets a development alternating current voltage to be applied to the development device, at 0 V (it takes approximately 50 ms) (step S101). Subsequently, the current detection circuit S5 attached to the grounding side of the photosensitive drum 1 detects the quantity of current flowing between the photosensitive drum and charging roller, and the high-pass filter of the current detection circuit S5 performs the processing to calculate the quantity of discharge current (steps S102, S103).

If the discharge current calculated in S103 is equal to a predetermined value (100 μA) or higher (S104), the CPU as a control unit performs processing assigned for S105. If it is lower than the predetermined value, the CPU performs processing assigned for S106.

If the quantity of discharge current is equal to the predetermined value (100 μA) or higher, the CPU 30 serving as a control unit 30 reduces the peak-to-peak value by a predetermined adjustment quantity (10 Vpp, in this case) so as to be lower than the peak-to-peak value applied in step S102 (S105). Thus, the quantity of discharge current can be made to approximate the predetermined value (100 μA).

If the quantity of discharge current is equal to the predetermined value (100 μA) or higher, the CPU 30 increases the peak-to-peak value by a predetermined adjustment quantity (10 Vpp, in this case) so as to be higher than the peak-to-peak value applied in step S102 (S106). Thus, the quantity of discharge current can be made to approximate the predetermined value (100 μA). As described above, approximately 50 ms is required to adjust a peak-to-peak value at one time. As to the quantity of adjustment of the peak-to-peak value, it is preferable to determine the maximum quantity of adjustment to be made all at once, taking into account of system safety.

Lastly, in order to carry out subsequent image formation, development bias to be applied to the developing sleeve serving as a developer carrier in the development device is turned on (a development alternating current voltage of 1500 Vpp) (S107). As in the case where development bias is turned off, approximately 50 ms is required to turn on development bias.

Thus, in the present embodiment, the waveform of the current is passed through a high-pass filter that passes a charging current higher than the charging frequency. Thereby the components of a discharge current included in the total current can be directly estimated. This makes it possible to exert control between sheets of paper, thus reducing control downtime to the shortest (approximately 150 ms, and if development OFF periods are not included, approximately 50 ms). Accordingly, image intervals (the intervals between images on a photosensitive drum) can be minimized to the shortest interval, thus increasing productivity. Since the quantity of discharge current can be obtained for each current detected, accuracy in controlling the quantity of discharge can improve. Additionally, a constant quantity of discharge can be generated without causing excessive discharge regardless, for example, of the environment or of variations in the resistance of a charging roller during its manufacture. Accordingly, uniform charging can be carried out free of problems such as deterioration of the photosensitive drum, toner fusion, or image flow. In addition, even where the charging roller is soiled, uniform charging can be carried out in consecutive image formation. This ensures a stable output of prints of high image quality for a long term. In control of the quantity of discharge current according to the present invention, a charging bias in which alternating current and direct current voltages overlap may be applied to the charging roller or only an alternating current voltage may be applied to the charging roller.

Flowchart for Another Form of Control

Figure 8:
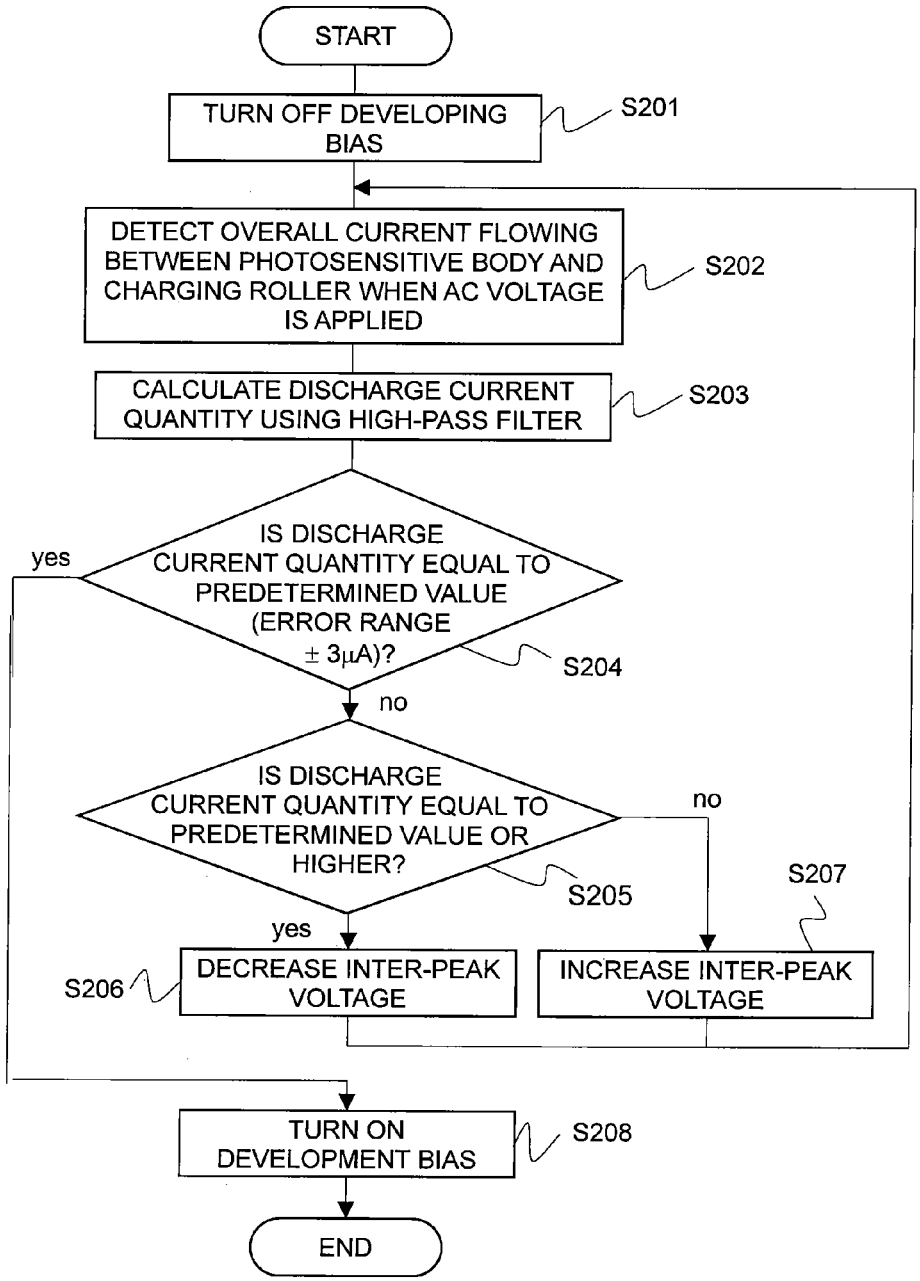
FIG. 8 is a flowchart for another form of discharge current quantity control according to the embodiment of the present invention.

Referring to the flowchart shown in FIG. 8, next will be described control exerted such that the peak-to-peak value is adjusted until the quantity of discharge current reaches a predetermined range (100±3 μA).

The processes from S201 to S203 are substantially identical to those from S101 to S103, and the process in step S208 is substantially identical to that in S207. Therefore, descriptions of these will be omitted.

Depending on whether the discharge current component detected by the current detection circuit in S203 is within a predetermined range or not, the CPU 30 serving as a control unit adjusts the process (S204). If the quantity of discharge current is within the predetermined range, the CPU 30 performs the process of step S208, and if beyond this range, the CPU 30 performs the process of step S205.

If a determination that the quantity of discharge current is beyond a predetermined range is made in S204, the CPU 30 adjusts the process depending on whether the quantity of discharge current obtained in step S203 is equal to a predetermined value or higher (S205). If the quantity of discharge current is equal to or exceeds the highest limit value (100+3 μA) in the predetermined range, the CPU 30 performs step S206, and if lower than the lowest limit value (100−3 μA) in the predetermined range, it performs step S207.

If a determination is made in S205 that the quantity of discharge current is equal to or exceeds the upper limit value of the predetermined range, the CPU 30 decreases by 5 Vpp the peak-to-peak value of the alternating current voltage applied to the charging roller (S206). If the determination is made in S205 that the quantity of discharge current is lower than the lower limit value of the predetermined range, the CPU 30 increases by 5 Vpp (S207) the peak-to-peak value of the alternating current voltage applied to the charging roller. After the peak-to-peak value has been adjusted in S206 or S207, the process in S202 is repeated. In fact, the foregoing processing is repeated until the value of the discharge current enters the predetermined range. This improves the accuracy of controlling the quantity of discharge current, compared to the above-described control using the predetermined value as illustrated in the flowchart.

§4. Other Embodiments

The present invention is not limited to the embodiment described above, but various changes and modifications may be made in the invention without departing from the spirit and scope of the invention determined by the claims thereof. For example, the charging roller and the photosensitive drum do not have to be in contact with each other but may be disposed close to each other with a space of several dozen μm between them, as long as a dischargeable area determined by the voltage in the gap and a corrected Pachen curve is ensured between the photosensitive drum and the charging roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-048307, filed Mar. 2, 2009, and No. 2010-003629, filed Jan. 12, 2010, which are hereby incorporated by reference herein in their entirety.

What is claimed is:

1. An image forming apparatus comprising:

a rotatable photosensitive member;

a charging device which charges the photosensitive member;

an applying unit which applies an alternating current voltage to the charging device;

a processing portion which extracts a discharge current component by removing an alternating current component corresponding to the alternating current voltage from a current flowing between the photosensitive member and the charging device; and a control unit which controls a peak-to-peak value of the alternating current voltage based on the discharge current component extracted by the processing portion.

2. The image forming apparatus according to claim 1, wherein the processing portion attenuates the alternating current component corresponding to the alternating current voltage, thereby extracting the discharge current component, and wherein the control unit controls the peak-to-peak value of the alternating current voltage so that the discharge current component is constant.

3. The image forming apparatus according to claim 1, wherein the charging device is in contact with the photosensitive member.

4. The image forming apparatus according to claim 1, wherein if the control unit determines that the discharge current component is equal to or greater than a predetermined value, the control unit increases the peak-to-peak value of the alternating current voltage.

5. The image forming apparatus according to claim 1, wherein if the control unit determines that the discharge current component is less than a predetermined value, the control unit decreases the peak-to-peak value of the alternating current voltage.

6. The image forming apparatus according to claim 1, wherein if the control unit determines that the discharge current component is equal to a predetermined value, the control unit does not adjust the peak-to-peak value of the alternating current voltage.

7. A method for charging a rotatable photosensitive member in an image forming apparatus, the method comprising the steps of:

charging, with a charging device, the photosensitive member;

applying an alternating current voltage to the charging device;

extracting, with a processing portion, a discharge current component by removing an alternating current component corresponding to the alternating current voltage from a current flowing between the photosensitive member and the charging device; and controlling, with a control unit a peak-to-peak value of the alternating current voltage based on the discharge current component extracted by the processing portion.

8. The method according to claim 7, wherein the processing portion attenuates the alternating current component corresponding to the alternating current voltage, thereby extracting the discharge current component, and wherein the control unit controls the peak-to-peak value of the alternating current voltage so that the discharge current component is constant.

9. The method according to claim 7, wherein the charging device is in contact with the photosensitive member.

10. The method according to claim 7, further comprising the step of increasing the peak-to-peak value of the alternating current voltage if the control unit determines that the discharge current component is equal to or greater than a predetermined value.

11. The method according to claim 7, further comprising the step of decreasing the peak-to-peak value of the alternating current voltage if the control unit determines that the discharge current component is less than a predetermined value.

12. The method according to claim 7, further comprising the step of not adjusting the peak-to-peak value of the alternating current voltage if the control unit determines that the discharge current component is equal to a predetermined value.

* * * * *